US007261815B2

(12) United States Patent
Cur et al.

(10) Patent No.: US 7,261,815 B2
(45) Date of Patent: Aug. 28, 2007

(54) WATER FILTER FOR REFRIGERATOR WATER DISPENSER

(75) Inventors: Nihat O. Cur, Saint Joseph, MI (US); Timothy T. Murphy, Saugatuck, MI (US); Michael A. Kahwaji, Los Angeles, CA (US); Paul B. Allard, Stevensville, MI (US); Guolian Wu, Saint Joseph, MI (US); Claiton E. Amaral, Joinville/SC (BR); Marcos Heinzle, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 142 days.

(21) Appl. No.: 11/248,809

(22) Filed: Oct. 12, 2005

(65) Prior Publication Data

US 2007/0080102 A1 Apr. 12, 2007

(51) Int. Cl.

| | |
|---|---|
| ***B01D 27/08*** | (2006.01) |
| ***B01D 35/153*** | (2006.01) |
| ***B01D 35/147*** | (2006.01) |
| ***F25D 23/12*** | (2006.01) |

(52) U.S. Cl. ..... 210/232; 210/234; 210/235; 210/175; 210/186; 210/249; 210/238; 210/443; 62/332; 62/389; 62/390

(58) Field of Classification Search ..... 210/232, 210/234, 235, 175, 186, 249, 238, 443; 62/332, 62/389, 390

See application file for complete search history.

(56) References Cited

U.S. PATENT DOCUMENTS

| | | | | |
|---|---|---|---|---|
| 2,229,850 | A | 1/1941 | Hoskins | |
| 2,354,272 | A | 7/1944 | Miller et al. | |
| 3,982,406 | A | 9/1976 | Hanson et al. | 62/339 |
| 4,915,831 | A | 4/1990 | Taylor | 210/232 |
| 5,083,442 | A | 1/1992 | Vlock | 62/338 |
| 5,135,645 | A | 8/1992 | Sklenak et al. | 210/97 |
| 5,320,752 | A | 6/1994 | Clack et al. | 210/282 |
| 5,707,518 | A * | 1/1998 | Coates et al. | 210/232 |
| 2001/0023843 | A1 * | 9/2001 | Senner et al. | 210/232 |
| 2004/0211717 | A1 * | 10/2004 | Mitchell et al. | 210/235 |

FOREIGN PATENT DOCUMENTS

| | | |
|---|---|---|
| EP | 1 139 045 A2 | 10/2001 |
| JP | 3043398 | 2/1991 |
| WO | 03/102481 A1 | 12/2003 |

* cited by examiner

*Primary Examiner*—Thomas M. Lithgow
(74) *Attorney, Agent, or Firm*—Michael D. Lafrenz; Kirk Goodwin

(57) ABSTRACT

A water dispenser in a refrigerator door can include a filter casing in the door opening into the bottom of the dispenser housing. The filter casing can include a top wall positioned in the bottom of the dispenser housing, a head assembly at the bottom of the filter casing connected to the water supply and to a water outlet in the dispenser, and can include a filter casing drain. A filter cartridge in the filter casing can connect to the head assembly. The filter casing can include a filter retainer mounted adjacent the opening into the filter casing and can hold the filter cartridge connected to the head assembly in a first position and can release the filter cartridge in a second position. The filter casing can include a drain line leading from the filter casing drain to a pan outside the refrigerated space.

20 Claims, 11 Drawing Sheets

WATER FILTER FOR REFRIGERATOR WATER DISPENSER

CROSS REFERENCE TO RELATED APPLICATIONS

This application is related to co-pending U.S. patent application Ser. No. 10/423,157 filed on Apr. 25, 2003 by Mitchell et al.

BACKGROUND OF THE INVENTION

1. Field of the Invention

The invention relates to appliances such as refrigerator freezers that can be provided with a water dispenser. Such appliances can have a filter to filter water to be dispensed to improve the taste and appearance of the water and can be arranged to remove undesirable chemicals from the water.

2. Description of the Prior Art

Refrigerator freezers having a filter for filtering water supplied to a water dispenser and to an automatic ice maker are known.

BRIEF SUMMARY OF THE INVENTION

In one aspect the invention relates to a refrigerator having an insulated cabinet and an insulated door including an outer panel, a liner, a water supply to the door and a water dispenser. The water dispenser can have a dispenser housing with side walls, a top and a bottom in the door extending inwardly from the outer panel toward the liner, a water outlet in the dispenser housing adjacent the top and a filter casing in the door opening into the dispenser housing. The filter casing can include a head assembly at one end of the filter casing connected to the water supply and to the water outlet and can have a filter cartridge positioned in the filter casing connected to the head assembly. The filter casing can also include a filter retainer mounted adjacent the opening into the filter casing and arranged to hold the filter cartridge connected to the head assembly in a first position and to release the filter cartridge in a second position. Moving the filter retainer to the second position can allow the filter cartridge to be disconnected from the head assembly and removed from the filter casing.

The filter casing can be positioned below the dispenser housing and the opening into the filter casing can be in the bottom of the dispenser housing. The dispenser can further include a tray removably mounted in the bottom of the dispenser housing covering the opening in the filter casing, and the filter retainer can be accessible when the tray is removed.

The filter casing can include a resilient latch and the filter cartridge can include a shoulder on a sidewall. The filter retainer can include a filter cover pivotally mounted adjacent the opening to the filter casing including a catch arranged to engage the resilient latch when the filter cover is in a closed position covering the opening to the filter casing. The filter casing can also include a cam having a cam surface to engage the shoulder on the filter cartridge when the cam is in a first position and to disengage from the shoulder when the cam is in a second position. The filter casing can include a pivotally mounted lever arranged to rotate the cam between the first position and the second position. The filter cover can be resiliently biased to an open position. The cam can engage the resilient latch to disengage the resilient latch from the catch when the cam is rotated from the first position to the second position by the lever thereby releasing the filter cover to pivot to the open position. Rotation of the cam from the first position to the second position can first disengage the resilient latch from the catch and then disengage the cam surface from the shoulder to allow removal of the filter cartridge from the filter casing.

In another aspect of the invention the filter retainer can comprise a button mounted to the filter casing axially movable along an axis parallel to the filter cartridge between a first position and a second position. The button can be resiliently biased to the first position and can be arranged to hold the filter cartridge connected to the head assembly in the first position and to release the filter cartridge in the second position. A lever can be pivotally mounted to overlie the button in a first position and to move the button from the first position to the second position to release the filter cartridge and allow removal of the filter cartridge upon movement to a second position. The lever can include a first end operated by a user and a second end engaged by the button. The lever can be pivotally mounted at a point spaced from the second end of the lever. The pivot can be positioned for the lever to be resiliently biased over center about the pivot in the first position and in the second position.

In another aspect of the invention the filter casing can include at least one generally funnel shaped recess in a sidewall beginning adjacent the opening into the dispenser housing. The filter cartridge can include at least one guide rail along a sidewall positioned to engage the funnel shaped recess when the filter cartridge is inserted into the filter casing. The funnel shaped recess can rotate the filter cartridge into the correct position to connect with the head assembly when fully inserted into the filter casing. The filter cartridge and the filter casing can be generally cylindrical in cross section. The widest portion of the generally funnel shaped recess can be adjacent the dispenser housing.

In another aspect of the invention the refrigerated space can include a below freezing freezer compartment and the insulated door can close the freezer compartment. The door liner can include an access opening adjacent the filter casing. The door liner can have an insulated cover for the access opening and insulation in the freezer door to cool the filter cartridge to an above freezing temperature. The refrigerator can include a valve housing adjacent the filter casing that can be accessible through the access opening. The valve housing can include at least one water valve in the valve housing connected in the water supply and the head assembly.

In another aspect the invention relates to a refrigerator having an insulated cabinet and an insulated door closing the refrigerated space having an outer panel and a liner. The refrigerator can have a water supply to the door and a water dispenser. The water dispenser can comprise a dispenser housing having side walls, a top and a bottom in the door extending inwardly from the outer panel toward the liner and can have a water outlet in the dispenser housing adjacent the top of the dispenser housing. The water dispenser can have a filter casing in the door opening into the bottom of the dispenser housing. The filter casing can include a top wall positioned in the bottom of the dispenser housing, a head assembly at the bottom of the filter casing connected to the water supply and to the water outlet and can include a filter casing drain. A filter cartridge can be positioned in the filter casing and can be connected to the head assembly. The filter casing can have a filter retainer mounted adjacent the opening into the filter casing that can be arranged to hold the filter cartridge connected to the head assembly in a first position and to release the filter cartridge in a second position. Moving the filter retainer to the second position can allow the filter cartridge to be disconnected from the head assembly and removed from the filter casing. A drain line can lead from the filter casing drain to a pan outside the refrigerated space. The insulated door can be hingedly mounted to the insulated cabinet with at least one hollow hinge pin and the drain line can pass through the hollow hinge pin to the pan.

In another aspect of the invention the refrigerator can include a machinery compartment having a condensate pan and the drain line can extend out of the insulated door. A drain catch can extend below the insulated door under the drain line when the insulated door is in a closed position, and the drain catch can conduct water from the drain line to the condensate pan.

DETAILED DESCRIPTION OF THE INVENTION

Refrigerator freezers with ice and water dispensers are well known and popular with consumers. Typically such refrigerator freezers are also provided with a replaceable water filter to improve the appearance and taste of ice cubes formed by the ice maker and water dispensed by the water dispenser. Typically such water filters have been located in the machinery compartment behind grill 21 to facilitate connection to the water system for the refrigerator freezer. While locating the filter in the machinery compartment facilitates connection to the water system, that location is not convenient for consumers to change the filter periodically as is typically required. Further, the location in the machinery compartment is typically warm so that the filter must be connected upstream from the cool water storage apparatus 23 that can be typically located in an above freezing storage space.

Figure 1:
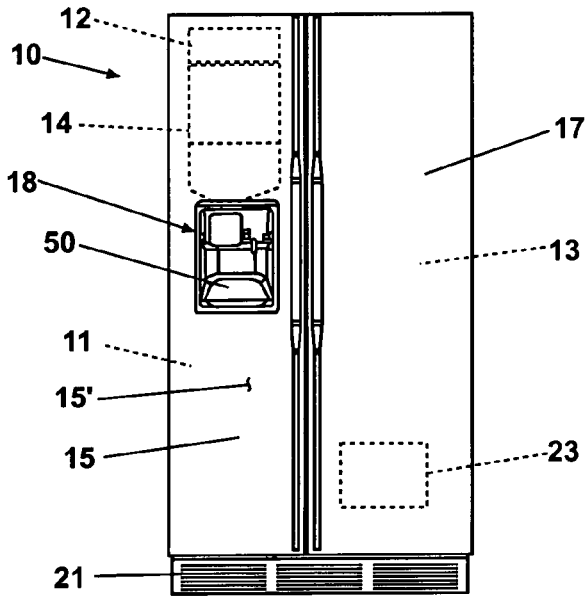
FIG. 1 is a front view of a refrigerator freezer that can employ a water filter according to the invention.
Figure 2:
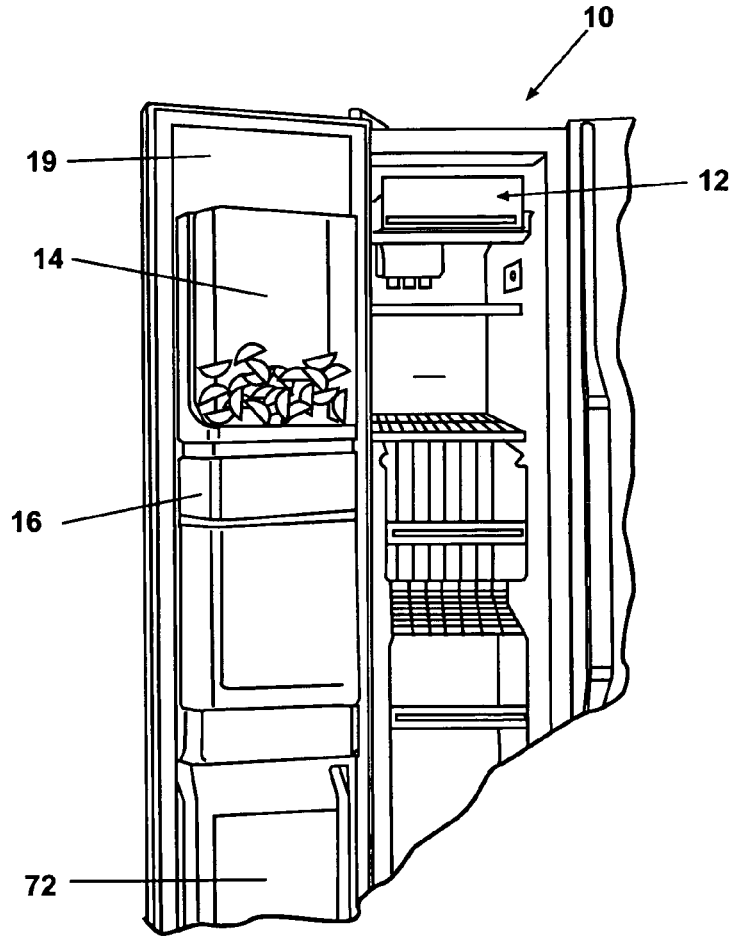
FIG. 2 is a partial front view of the refrigerator freezer of FIG. 1 with the freezer door open.

A water filter according to the invention can be mounted in a filter casing positioned in a refrigerator freezer door adjacent the water dispenser. A water filter according to the invention can be used with a water dispenser that can be part of an ice and water dispenser positioned in the freezer compartment door. The water filter apparatus according to the invention will be described in connection with an ice and water dispenser for a side-by-side refrigerator freezer. Those skilled in the art will understand that the water filter apparatus according to the invention can be used with a water only dispensing apparatus in any refrigerator freezer configuration, and can be located in either a refrigerator compartment door or a freezer compartment door. Similarly, those skilled in the art will understand that a water filter apparatus according to the invention can be used with any appliance having a water dispensing mechanism in which it would be desirable to incorporate a water filter to improve the taste and appearance of water dispensed. Referring to FIG. 1 and FIG. 2, a refrigerator freezer 10 can have a below freezing temperature freezer compartment 11 and an above freezing temperature refrigerator compartment 13. The refrigerator freezer 10 can have a refrigerator compartment door 17 a freezer compartment door 15 and a grill 21 closing a machinery compartment, not shown, behind grill 21. Freezer compartment door 15 can have an ice bin 14 and an ice dispensing mechanism 16 carried on inner door panel 19 positioned in freezer compartment 11. Typically ice and water dispenser 18 can be recessed in the outer panel 15' of freezer compartment door 15. Freezer compartment 11 can have an ice maker 12 positioned along the top wall of freezer compartment 11 and can be arranged to drop ice cubes into ice storage bin 14 all as disclosed in U.S. Pat. Nos. 6,050,097; 6,082,130; 6,286,324; 6,314,745 and 6,351,958 fully incorporated herein by reference. Refrigerator freezer 10 can have a chilled water storage apparatus 23 that can be located in an above freezing storage space, typically in the refrigerator compartment 13. Chilled water storage apparatus 23 can be a tank, coil of tubing or similar structure to hold a desired amount of water as is well known in the art. Chilled water storage apparatus 23 can be connected to suitable water valves to control flow of water from the building water system to the ice maker 12 and water dispenser 18 all as is well known in the art.

Figure 3:
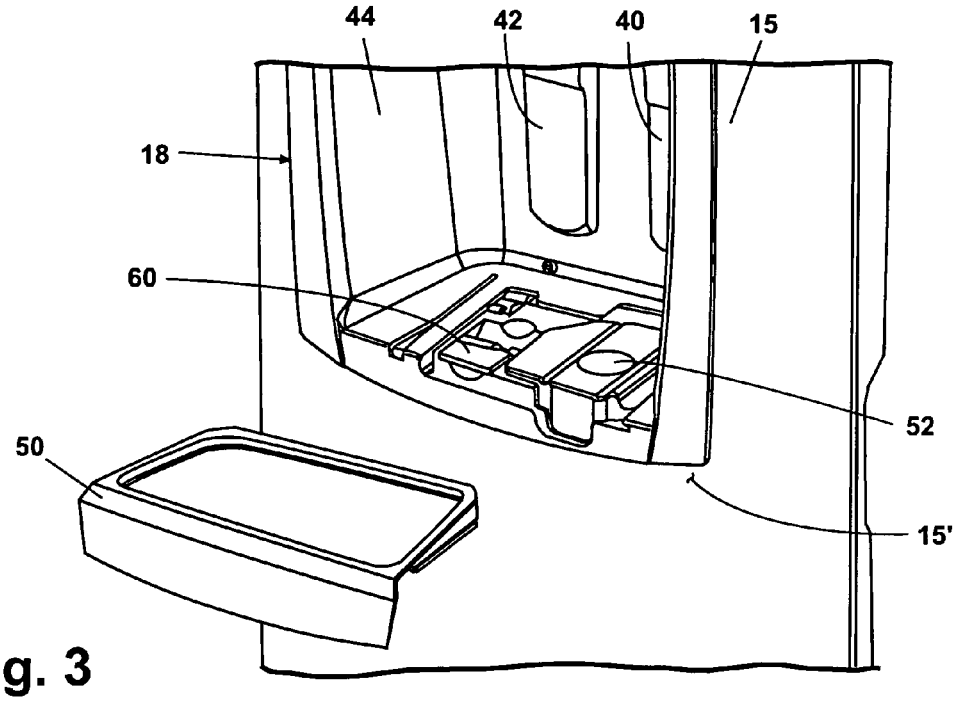
FIG. 3 is a partial front perspective view of a refrigerator freezer having a water filter according to the invention with the removable tray spaced from the dispenser cavity.
Figure 4:
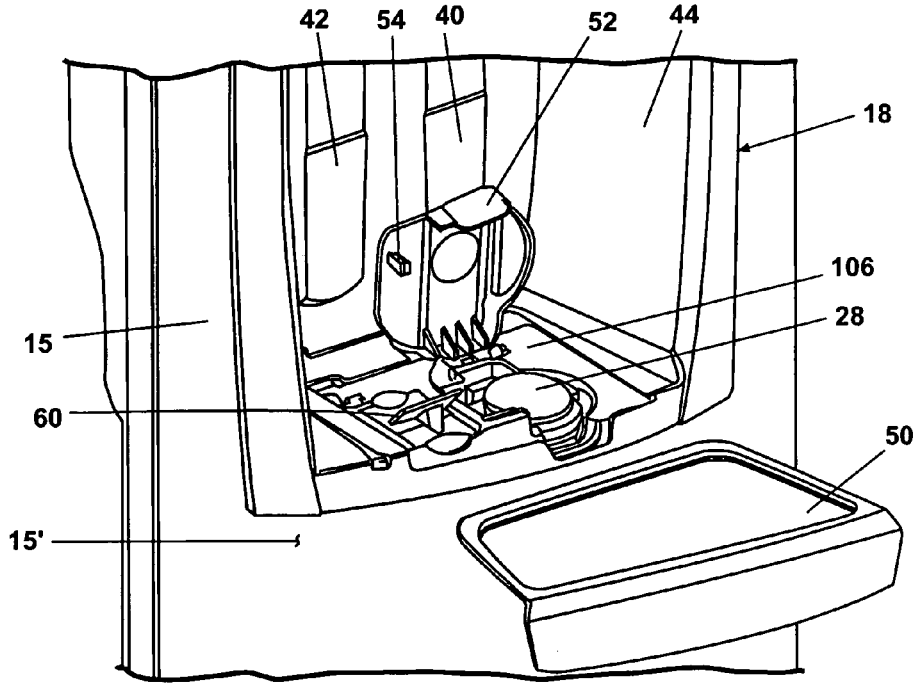
FIG. 4 is a partial front perspective view of the embodiment of FIG. 3 with the filter cover opened.

Referring to FIGS. 3 and 4, a water filter apparatus according to the invention can be seen in a freezer compartment door 15. Ice and water dispenser 18 can be located in the freezer compartment door 15 extending inwardly from outer panel 15' toward the inner door panel 19. Ice and water dispenser 18 can include a dispenser housing 90 (see FIG. 10) that can have a suitable shell 44 supported by the dispenser housing 90 to form the exposed surface of the dispenser cavity. Shell 44 can include a water dispenser control pad 40, an ice dispenser control pad 42 and suitable tracks (not shown) to support a removable tray 50 that can form a finished surface for the bottom wall of the ice and water dispenser 18. The dispenser cavity can also include a water outlet (not shown) and an ice delivery outlet (not shown) as are well known in the art. A filter cartridge and filter casing according to the invention can be exposed by removing tray 50 as shown in FIGS. 3 & 4. According to the invention, see FIGS. 5 and 10 together with FIGS. 3 & 4, a generally tubular filter casing 108 can have a top wall 106 that can be supported by dispenser housing 90 to form a bottom wall for the dispenser cavity. Filter casing 108 can have a generally tubular portion 109 that can enclose a water filter cartridge 20. Cartridge water filters are well known in the art and are often used in refrigerator freezers having a water and/or ice dispenser. As mentioned above, tray 50 can be removably positioned over filter casing top wall 106 to provide a finished surface suitable for supporting containers into which ice cubes or water are being dispensed.

Figure 5:
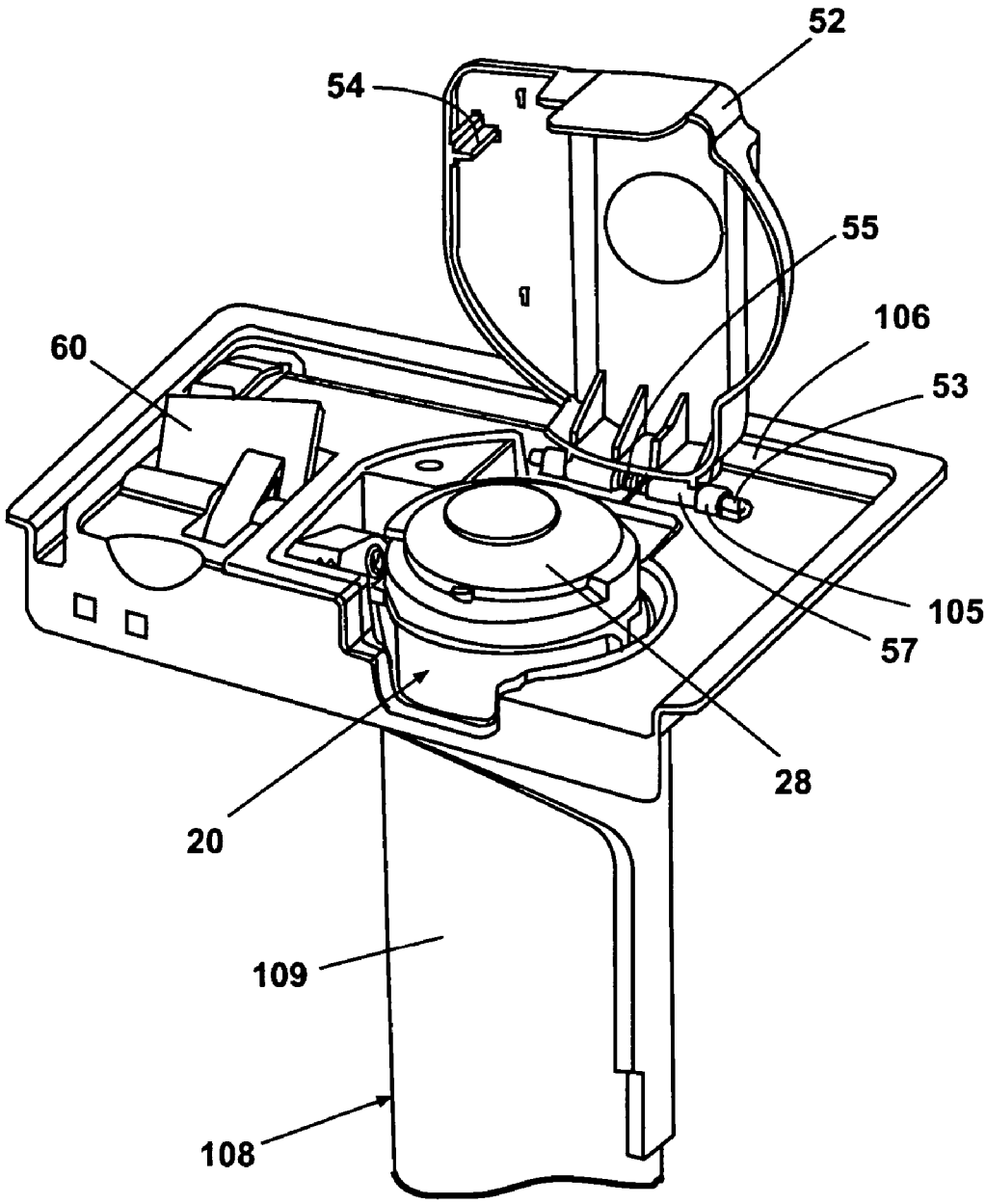
FIG. 5 is a partial perspective view of one embodiment of a filter casing according to the invention removed from a refrigerator freezer.
Figure 5A:
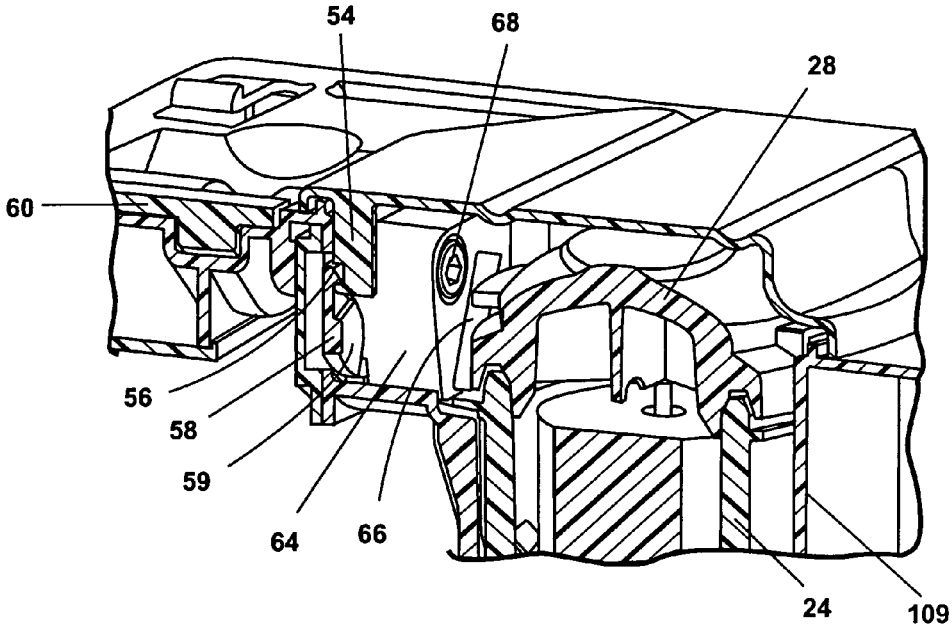
FIG. 5A is a partial section view through a filter cartridge casing of the embodiment of FIG. 5 illustrating a cross section through the latch for the filter cover.
Figure 5B:
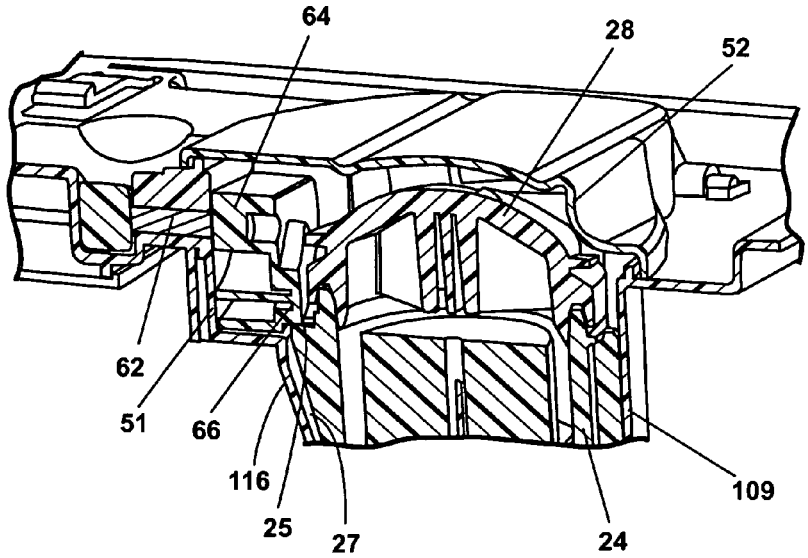
FIG. 5B is a partial section view through a filter casing of the embodiment of FIG. 5 illustrating a cross section through the cam surface holding the filter cartridge in place in the filter casing.
Figure 5C:
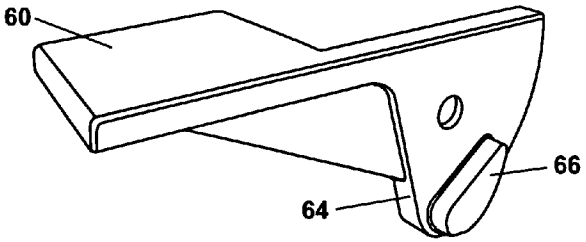
FIG. 5C is a perspective view of the lever, cam and cam surface removed from the filter casing illustrating the cam surface.
Figure 5D:
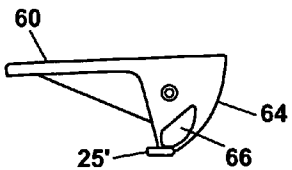
FIGS. 5D-5K are side views of the lever, cam and cam surface rotated from the latched position in FIG. 5D to the unlatched position in FIG. 5K illustrating the operation of the cam surface latching a filter cartridge in place in the filter casing.
Figure 5E:
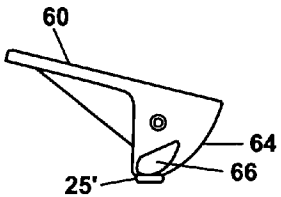
Figure 5F:
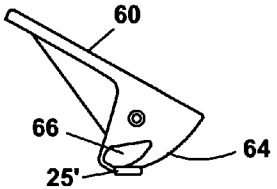
Figure 5G:
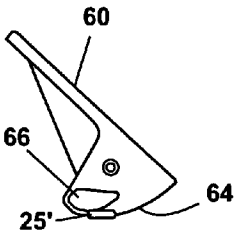
Figure 5H:
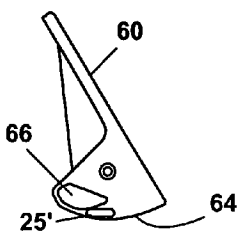
Figure 5I:
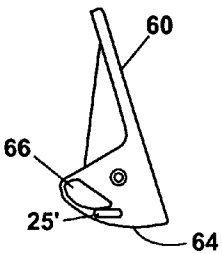
Figure 5J:
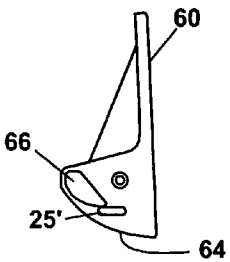
Figure 5K:
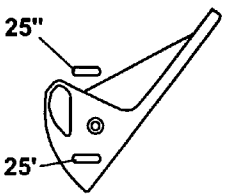
Figure 6:
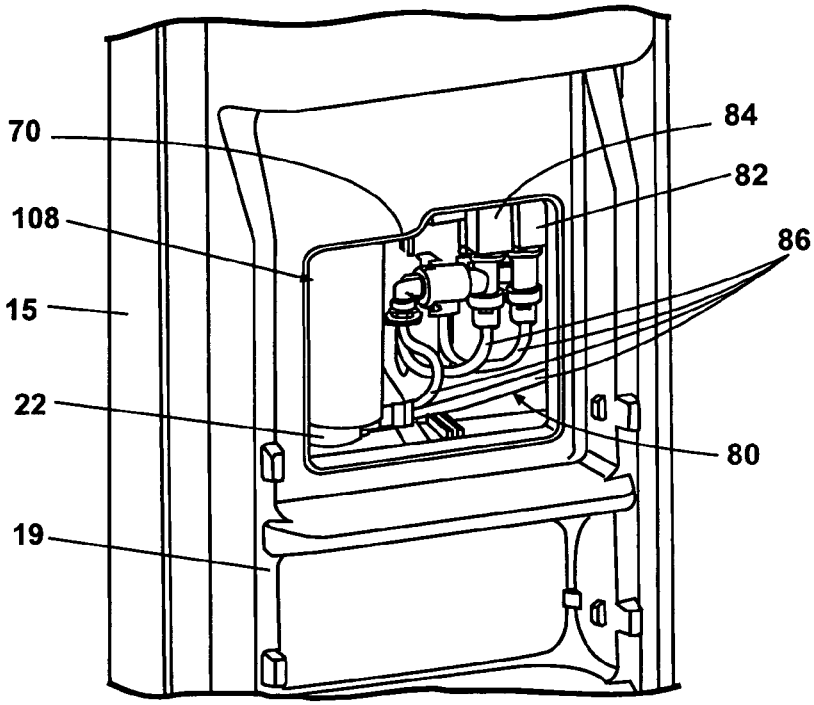
FIG. 6 is a partial perspective view of the freezer door with an access cover removed illustrating a valve housing that can be used with a filter according to the invention.

A filter cover 52 can be provided to keep liquid or solid material from falling down into generally tubular portion 109 of filter casing 108. Liquid or solid material could interfere with installation of a filter cartridge 20 or contaminate the water system, particularly when tray 50 is not in position as shown in FIG. 1. Filter cover 52 can be pivotally mounted to top wall 106 by a shaft or axle 53 arranged to pass through axle journals 57 that can be formed in the filter cover 52 and axle journals 105 that can be formed in top wall 106. Those skilled in the art will understand that other suitable hinge arrangements can be used to pivotally mount filter cover 52 to top wall 106. A spring 55 can be provided around axle 53 to bias filter cover 52 to the open position (FIGS. 4 & 5). Those skilled in the art will understand that other resilient biasing arrangements can be made to bias filter cover 52 to the open position. Referring to FIGS. 5 and 5A, filter cover 52 can have a catch 54 extending downwardly from the bottom side of filter cover 52. Top wall 106 can have a spring arm 58 that can be formed in a vertical wall 51 positioned adjacent the upper portion of generally tubular portion 109. Spring arm 58 can have a cover latch 56 formed in the upper end of spring arm 58 shaped to engage catch 54. Cover latch 56 can engage catch 54 to hold filter cover 52 in the closed position (FIGS. 3 and 5A). Cover latch 56 can be a tooth formed by a recess in spring arm 58 that can be sized to engage a notch in the distal end of catch 54. A cam 64 can be rotatably mounted on vertical wall 51 adjacent spring arm 58. Spring arm 58 can include a raised surface portion 59 arranged to be engaged by cam 64 as cam 64 is rotated to flex spring arm 58. Flexing spring arm 58 can move cover latch 56 away from catch 54. Thus, rotating cam 64 can disengage cover latch 56 from catch 54 and allow filter cover 52 to move to the open position shown in FIGS. 4 & 5. Cam 64 can be connected to lever 60 by fastener 68, or as will be understood by those skilled in the art by other suitable connection arrangements that can include snap together components or gluing cam 64 to lever 60. When lever 60 is lifted from the position in FIG. 3 to the position in FIG. 4 cam 64 can rotate over raised surface portion 59 and spring arm 58 can be depressed. Raised surface portion 59 can be sufficient to depress spring arm 58 enough for cover latch 56 to disengage from catch 54 and allow filter cover 52 to open to the FIGS. 4 & 5 position under the force of spring 55 bearing on filter cover 52.

Next, referring to FIGS. 5 and 5B-5K, latching of filter cartridge 20 will be explained. Filter cartridge 20 can include a generally tubular housing 24. Adjacent to the top of filter cartridge 20 housing 24 can have a ramped surface 27 projecting outwardly and terminating in a shoulder 25. Filter casing tubular portion 109 can include a recess 116 formed in the upper end of tubular portion 109 that can be sized to receive ramped surface 27. Cam 64 can have an arcuate cam surface 66 extending outward from near the pivot point of cam 64 about shaft 62 toward the bottom edge of cam 64. In the closed position (see FIGS. 3 and 5B) cam surface 66 can be in contact with shoulder 25 to hold filter cartridge 20 in the installed position connected to the refrigerator freezer water system as will be described below. As cam 64 is rotated from the FIG. 4 position to the FIG. 5 position cam surface 66 can rotate clear of shoulder 25 to allow filter cartridge 20 to be lifted vertically out of filter casing 108. FIGS. 5D-5K illustrate the interaction of cam surface 66 and shoulder 25 (in FIGS. 5D-5K bar 25' illustrates the position of shoulder 25 when filter cartridge 20 is in the latched position and bar 25" illustrates the position of shoulder 25 in the unlatched position and filter cartridge 20 has been able to pop up for removal as will be explained in detail below). As lever 60 is lifted from the FIG. 5D position cam surface 66 can slide along shoulder 25 (illustrated by bar 25'). As lever 60 moves from the FIG. 5J to the FIG. 5K position cam surface 66 can disengage from shoulder 25 an allow ramped surface 27 and shoulder 25 to move past rotated cam surface 66 to the position illustrated by bar 25". When a filter cartridge 20 is inserted into filter casing 108 and lever 60 is rotated from the FIG. 5 position to the FIG. 3 position cam surface 66 can engage shoulder 25 and force filter cartridge 20 into connection with the water system as described in detail below. When a filter cartridge 20 is inserted and pressed into filter casing 108, lever 60 can be rotated to the FIG. 5J position so that cam surface 66 can engage shoulder 25 (illustrated by bar 25'). Continuing to rotate lever 60 from the FIG. 5J position to the FIG. 5D position can force filter cartridge 20 into the latched position. So long as lever 60 remains in the FIG. 3 position, filter cartridge 20 can not move upwardly out of filter casing 108.

Turning to FIGS. 6-8 and 10, connection or disconnection of a filter cartridge 20 to the refrigerator water system can be seen. Filter cartridge 20 can have an inlet fitting 30 and an outlet fitting 32 positioned on first end 26 of filter cartridge 20 that can connect the filter cartridge 20 to the refrigerator water system by insertion into head assembly 22. The operation of the inlet fitting 30, outlet fitting 32 and head assembly is explained in detail in co-pending U.S. patent application Ser. No. 10/423,157 filed by Mitchell et al (Mitchell et al '157) and fully incorporated in this application by reference. Inlet fitting 30 can be received in port housing 48 located in head assembly 22. Similarly, outlet fitting 32 can be received in a port housing (not shown). Filter cartridge 20 can also include a protrusion 33 extending from first end 26 to assure proper alignment of filter cartridge 20 in filter casing 108. Protrusion 33 can be received in piston housing 35 that can include a piston 34 and a spring 36 biasing piston 34 upwardly toward the top of piston housing 35. When filter cartridge 20 is fully inserted in head assembly 22 protrusion 33 can engage and depress piston 34 and compress spring 36 to provide an upward spring bias to filter cartridge 20. As described above, cam 64 and cam surface 66 can engage shoulder 25 to hold filter cartridge 20 in position against the spring bias of spring 36. When cam 64 is rotated so that cam surface 66 rotates out of engagement with shoulder 25 (see FIG. 5K), as described above, spring 36 can force piston 34 upwardly to lift filter cartridge 20 partially out of filter casing 108 to the position shown in FIG. 5 to facilitate removal by the user by grasping second end 28.

Figure 7:
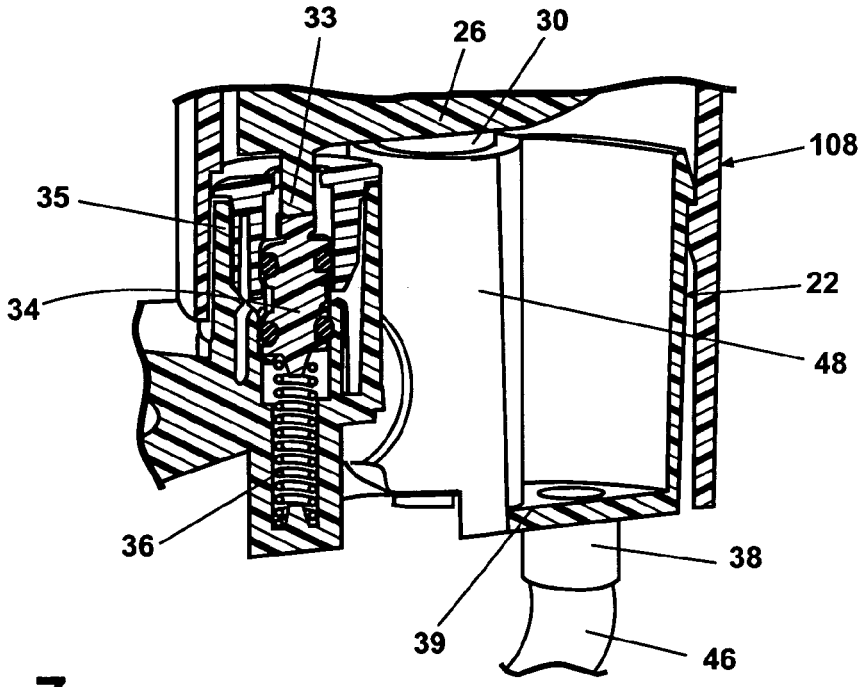
FIG. 7 is a partial section view of one embodiment of the bottom portion of a filter casing according to the invention illustrating a filter casing drain.
Figure 7A:
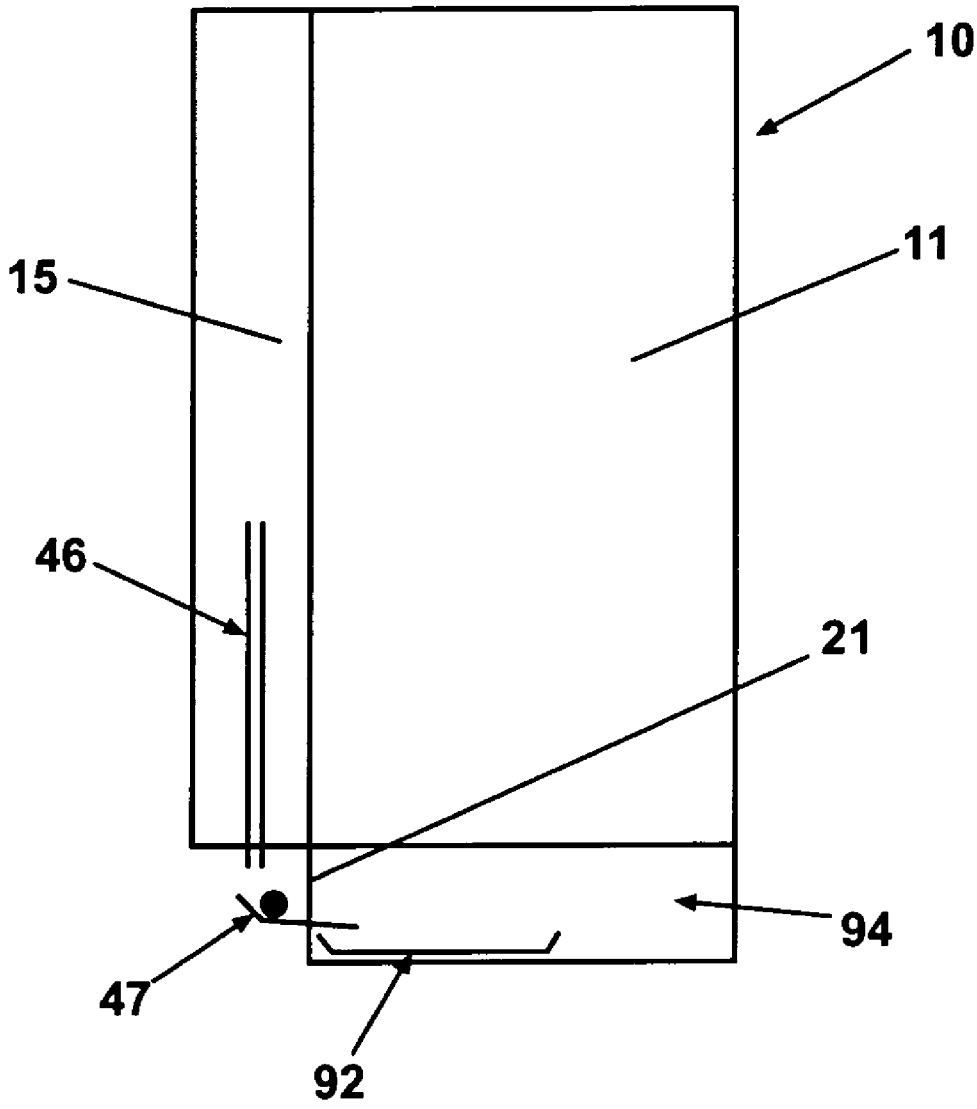
FIG. 7A is a schematic view of one embodiment of a filter casing drain line leading to the machinery compartment of a refrigerator freezer.
Figure 10:
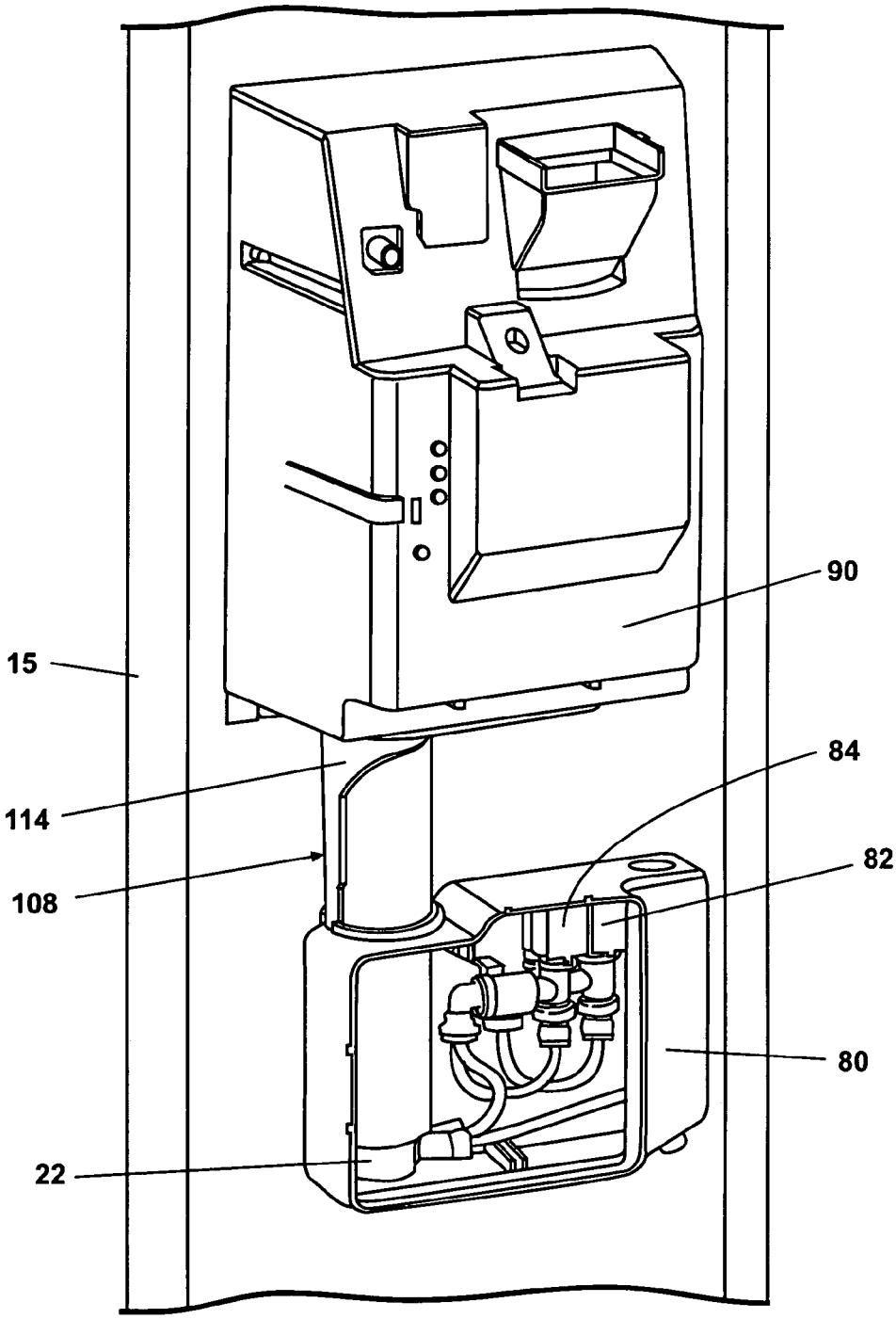
FIG. 10 is a partial perspective view of the inside of a freezer door with the inner door panel and insulation removed illustrating one embodiment of a filter casing, valve housing and dispenser housing according to the invention.

Head assembly 22 can be positioned in the bottom end of filter casing 108 as shown in FIGS. 7 & 10. Head assembly 22 can be retained in the end of filter casing 108 by interconnecting surfaces or glued or spin welded in the end of filter casing 108 as is well known in the art. Head assembly 22 can include a drain 38 in the bottom wall 39 of head assembly (see FIG. 7). Drain 38 can drain any water released when inlet fitting 30 and outlet fitting 32 are connected or disconnected from the port housings in the head assembly 22 when a filter cartridge 20 is installed or removed. As explained in detail in Mitchell et al '157 the port housings in the head assembly 22 and the inlet and outlet fittings are arranged to preclude any substantial release of water when a filter cartridge 20 is installed or removed. However, a small amount of water can be released and could accumulate in filter casing 108 without provision of a drain 38. Drain 38 can be connected to a drain line 46 that can lead to a condensate pan 92 (FIG. 7A) that can be located in the machinery compartment 94 (FIG. 7A) of the refrigerator freezer 10 behind grill 21. Drain line 46 can pass through a hollow hinge pin (not shown) for freezer compartment door 15. Alternately, as shown in FIG. 7A drain line 46 can exit the bottom edge of freezer door 15. When the freezer door 15 is closed as illustrated in FIG. 7A, drain line 46 can terminate above a drain catch 47 that can protrude from grill 21 to extend under drain line 46. Drain catch 47 can form a conduit leading into machinery compartment 94 and terminate over condensate pan 92 that can be positioned in machinery compartment 94. Condensate pan 92 can be provided to hold water generated during defrost cycles for evaporation by the heat of the compressor and condenser (both not shown) as is well known in the art. Typically, when a filter cartridge 20 is changed door 15 will be in the closed position and any water escaping into head assembly 22 can drain through drain 38 into drain line 46, drip into drain catch 47 and flow into condensate pan 92. As mentioned above, drain line 46 can be routed through a door hinge (not shown) into condensate pan 92 if sufficient room is available in the hollow door hinge for drain line 46 and other elements typically routed through a hollow door hinge such as wiring and a water line.

Head assembly 22 and the bottom portion of filter casing 108 can be accessed through access opening 70 in inner door panel 19 that can lead to valve housing 80. Valve housing 80 can enclose the bottom of filter casing 108 and house water valves 82 and 84 that can control flow of water to ice maker 12 and water dispenser 18 as is well known in the art. Appropriate water lines 86 can connect water valves 82 and 84 with head assembly 22 and can lead to cool water storage apparatus 23, the ice maker 12 and water dispenser 18 again as well known in the art. Locating filter cartridge 20 adjacent ice and water dispenser 18 downstream from cool water storage apparatus 23 can provide the benefit of filtering water just prior to delivery to the ice maker 12 or to the ice and water dispenser 18.

Figure 11:
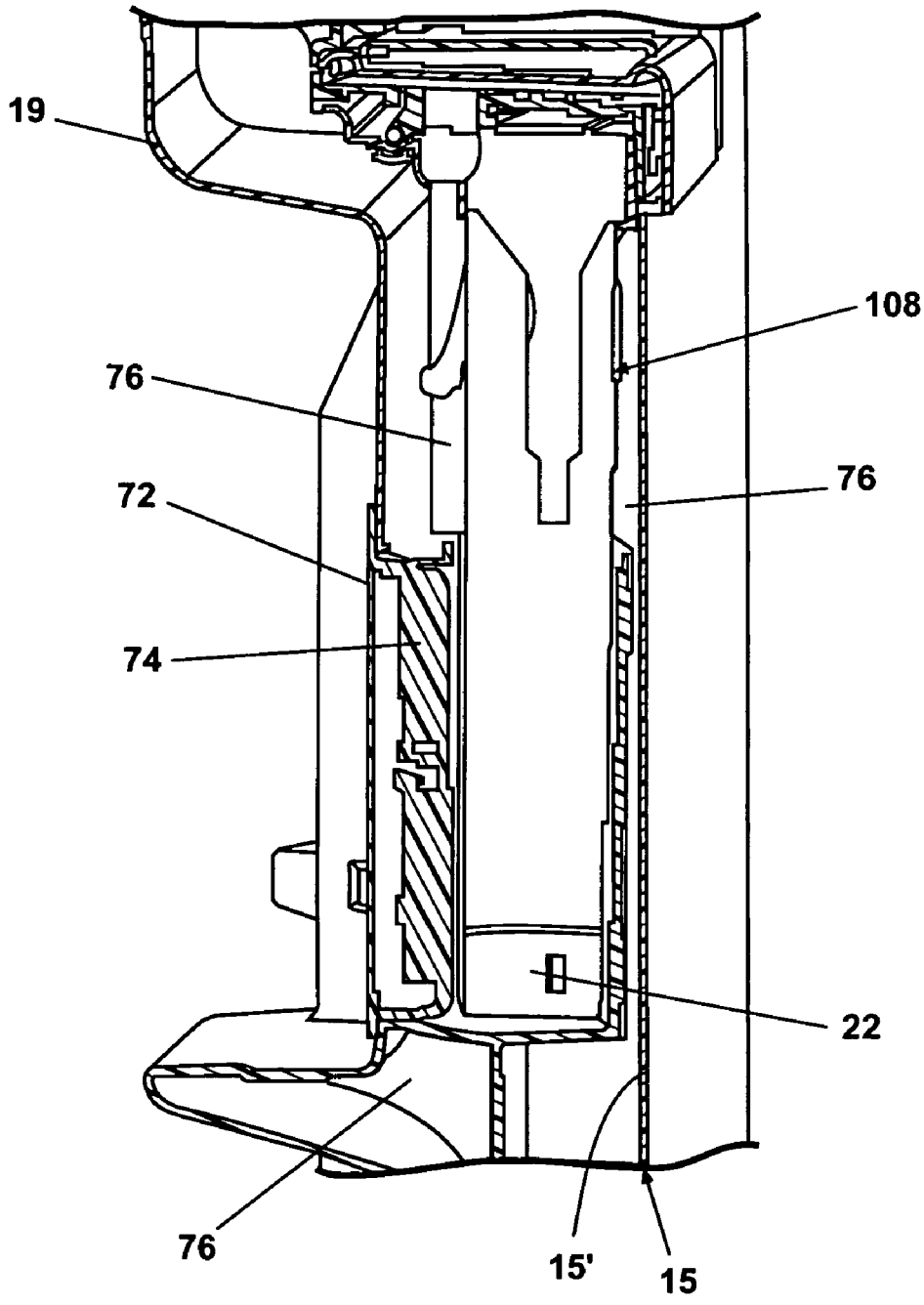
FIG. 11 is a partial cross section view through a freezer door illustrating the filter casing, access cover and insulation in the door.

Referring now to FIGS. 10 & 11, filter casing 108 can be positioned in freezer compartment door 15 in the insulation space between the outer panel 15' of the freezer compartment door 15 and the inner door panel 19. Freezer door insulation 76 can be positioned between filter casing 108 and outer panel 15'. Freezer door insulation 76 can also be positioned between filter casing 108 and inner door panel 19 all as well known in the art. Access door 72 can include access door insulation 74. Filter cartridge 20 can be maintained at a desired above freezing temperature by selecting the insulation value and arranging the thickness of freezer door insulation 76 and access door insulation 74. For example, freezer door insulation and access door insulation can be polyurethane foam insulation, expanded polystyrene insulation, aerogel or vacuum panel insulation as are well known in the art. Maintaining the temperature of filter cartridge 20 and water contained in the filter cartridge 20 at temperatures in the range of 37° F. to 55° F. can significantly reduce the tendency of biological contaminants to grow in the filter material as it is known to those skilled in the art that the rate of bacteria growth increases exponentially with temperature. Thus, positioning filter cartridge 20 in the freezer compartment door adjacent ice and water dispenser 18 can provide the benefit of maintaining the filter at an above freezing temperature to reduce the tendency of biological contaminants to grow in the filter material and also to filter the water just prior to dispensing or filling the ice maker 12.

Figure 8:
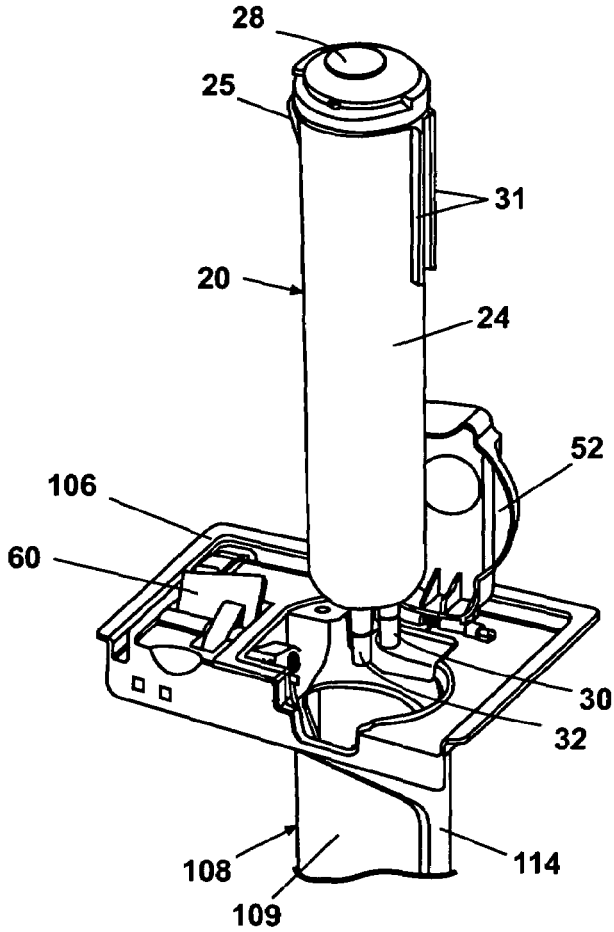
FIG. 8 is a partial perspective view of a filter casing of the embodiment of FIG. 5 with the filter cartridge removed from the filter casing and spaced above the filter casing.
Figure 9:
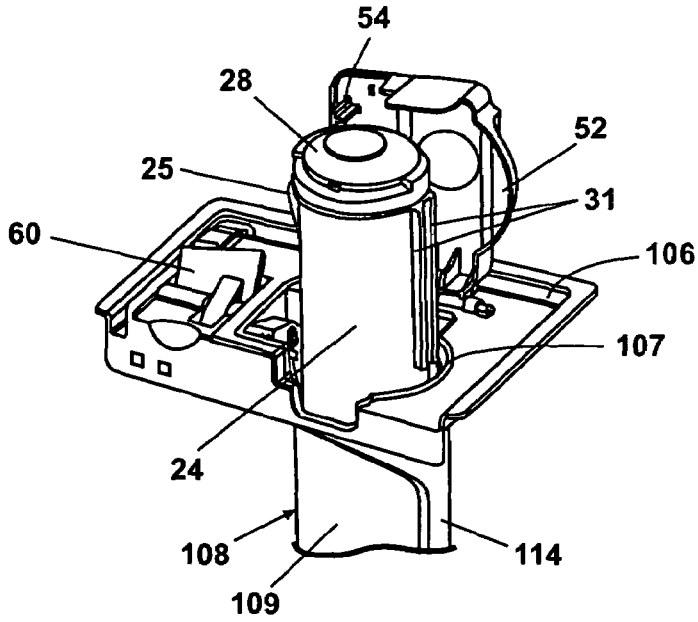
FIG. 9 is a partial perspective view of a filter casing of the embodiment of FIG. 5 with the filter cartridge partially inserted into the filter casing illustrating the guide rails on the filter cartridge and the guide rail recess on the filter casing.

Referring to FIGS. 8 & 9, filter cartridge 20 can be provided with one or more guide rails 31 that can extend from second end 28 a portion of the length of filter cartridge portion 24 in a generally axial direction. Guide rails 31 can be arranged to interact with guide rail recesses 114 that can be formed in tubular portion 109 of filter casing 108 to form a recess on the inside of tubular portion 109. Guide rail recess 114 can flare wider at the open end 107 at the top of tubular portion 109 to form a generally funnel shaped recess in the inner wall of tubular portion 109. As filter cartridge 20 is inserted into tubular portion 109 guide rails 31 can contact guide rail recess 114. The upper funnel shaped configuration of guide rail recess can cause filter cartridge 20 to rotate so that guide rails 31 are centered in guide rail recess 114 as filter cartridge 20 slides down into tubular portion 109. Guide rail recess 114 and guide rails 31 can be arranged so that when filter cartridge 20 is substantially inserted into filter casing 108, inlet fitting 30 and outlet fitting 32 as well as protrusion 33 can be aligned with respective ports in head assembly 22. Thus, guide rails 31 and guide rail recess 114 can facilitate insertion of a new filter cartridge into filter casing 108 without the difficulty of aligning filter cartridge fittings and head assembly ports without being able to observe filter cartridge fittings and head assembly ports. Two guide rails are shown in FIGS. 8 & 9 although those skilled in the art will understand that one or three or more guide rails can be used if desired.

Figure 12:
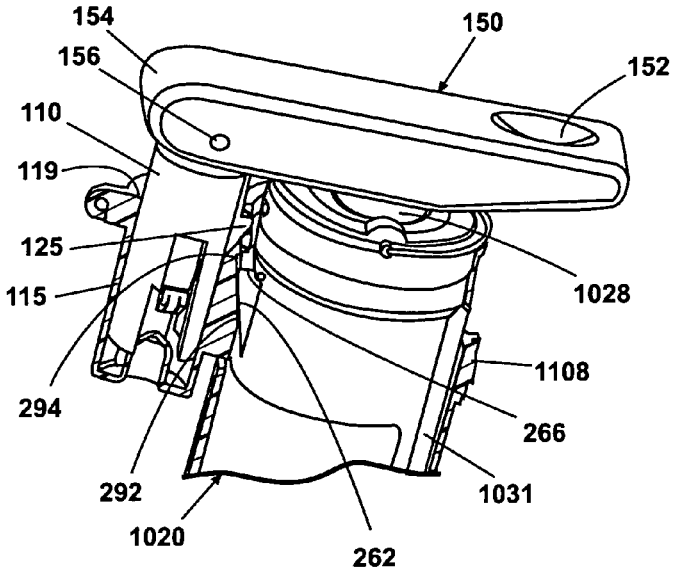
FIG. 12 is a partial perspective of another embodiment of filter casing according to the invention removed from a refrigerator freezer door.
Figure 12A:
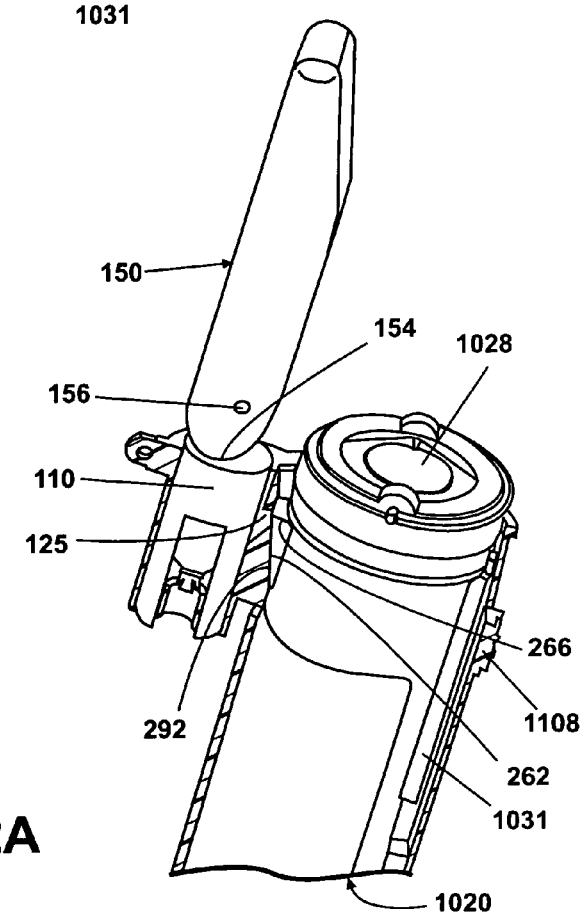
FIG. 12A is a partial perspective view of the filter casing embodiment of FIG. 12 with filter cartridge unlatched from the housing for removal.

Turning to FIGS. 12 & 12A another filter retainer embodiment can be seen. Filter and filter casing components that can be common with the embodiments described above are identified with reference numerals adding 1000 to the reference numeral used above. A filter cover is not shown in the embodiment of FIGS. 12 & 12A although those skilled in the art will understand that a filter cover generally similar to the filter cover described above can be provided for use with the filter retainer embodiment of FIGS. 12 & 12A if desired.

Likewise, the filter retainer embodiment illustrated in FIGS. 12 & 12A does not include illustration of an ice and water dispenser housing, freezer compartment door or other associated components shown in the embodiments described above. Those skilled in the art will understand that filter casing 1108 and filter cartridge 1020 can be used in lieu of filter casing 108 and filter cartridge 20 in combination with a dispenser housing 90 and a valve housing 80 in a freezer compartment door 15. Filter casing 1108 can be provided with a top wall (not shown) that can be generally similar to top wall 106 described above modified to accommodate the filter retainer apparatus in the embodiment of FIGS. 12 & 12A.

The filter retainer apparatus in the embodiment of FIGS. 12 & 12A is described in detail in Mitchell et al '157 and incorporated by reference herein. Filter cartridge 1020 can be held in filter casing 1108 by interference of end wall 266 of inclined surface 262 on filter cartridge 1020 with face 294 on filter casing 1108 at the top of inclined face 292 as described in Mitchell et al '157. Filter cartridge 1020 can be released from filter casing 1108 by pressing button 110. Pressing button 110 can drive angled wall 125 down against inclined surface 262 on filter cartridge 1020. When button 110 has moved down to the position shown in FIG. 12A, angled wall 125 has displaced filter cartridge 1020 sideways to disengage end wall 266 from face 294. Once end wall 266 is disengaged from face 294 the filter cartridge 1020 can move upwardly as described above in connection with filter cartridge 20. In Mitchell et al '157, button 110 can be pressed by a user to release a filter cartridge 1020. Due to the loading of the spring (spring 36 in FIG. 7) it can require some effort to depress button 110 to release a filter cartridge 1020. To facilitate release of a filter cartridge 1020 a lever 150 can be provided to operate button 110. Lever 150 can be pivoted about pivot 156 adjacent button 110. Pivot 156 can be an axle mounted to a top wall structure (not shown) that can be connected to, or integral with filter casing 1108 similar to top wall 106 as described above. Lever 150 can have a first end 152 arranged to be operated by a user and a second end 154. Second end 154 can be located on the opposite side of pivot 156 at a distance selected to provide a desired mechanical advantage to assist a user in operating button 110. As described in Mitchell et al '157 button 110 can have a spring, not shown, positioned between button 110 and button housing 115 having an open end 119 to bias button 110 upwardly against second end 154. The configuration of second end 154 and pivot 156 can be selected so that lever 150 is over center in both the FIG. 12 and the FIG. 12A positions and can be arranged to stay in either position without user intervention. Thus, to remove a filter cartridge 1020 from filter casing 1108 an operator need only lift lever 150 from the FIG. 12 position to the FIG. 12A position to disengage end wall 266 from face 294. Once disengaged, filter cartridge 1020 can then be lifted out of filter casing 1108. To insert a new filter cartridge the process can be reversed. A filter cartridge 1020 can be inserted into filter casing 1108. Filter casing 1108 can include a guide rail recess (not shown) to position filter cartridge 1020 for connection with head assembly 22 (FIG. 7). As described above, filter cartridge 1020 can include one or more guide rails 1031 that can be arranged to cooperate with guide rail recesses (not shown) in filter casing 1108 to properly position filter cartridge 1020 for connection to a head assembly (not shown). Once a filter cartridge 1020 is in the position shown in FIG. 12A properly aligned with head assembly 22 (FIG. 7) lever 150 can be moved to the position shown in FIG. 12. As lever 150 is pressed down on second end 1028 inclined surface 262 on filter cartridge 1020 engages inclined surface 292 to displace filter cartridge 1020 sideways so that end wall 266 can engage face 294 to latch filter cartridge 1020 in connection with head assembly 22.

While the invention has been specifically described in connection with certain specific embodiments thereof, it is to be understood that this is by way of illustration and not of limitation, and the scope of the appended claims should be construed as broadly as the prior art will permit.

What is claimed is:

1. A refrigerator having an insulated cabinet forming a refrigerated space;

an insulated door closing the refrigerated space having an outer panel and a liner;

a water supply to the door;

a water dispenser comprising;

a dispenser housing having side walls, a top and a bottom in the door extending inwardly from the outer panel toward the liner;

a water outlet in the dispenser housing adjacent the top;

a filter casing in the door opening into the dispenser housing including:

a head assembly at one end of the filter casing connected to the water supply and to the water outlet;

a filter cartridge positioned in the filter casing connected to the head assembly; and a filter retainer mounted adjacent the opening into the filter casing and arranged to hold the filter cartridge connected to the head assembly in a first position and to release the filter cartridge in a second position;

wherein moving the filter retainer to the second position allows the filter cartridge to be disconnected from the head assembly and removed from the filter casing.

2. The refrigerator according to claim 1, wherein the filter casing is positioned below the dispenser housing and the opening into the filter casing is in the bottom of the dispenser housing.

3. The refrigerator according to claim 2, wherein the dispenser further includes a tray removably mounted in the bottom of the dispenser housing covering the opening in the filter casing.

4. The refrigerator according to claim 3, wherein the filter retainer is accessible when the tray is removed.

5. The refrigerator according to claim 2, wherein the filter casing includes a resilient latch, the filter cartridge includes a shoulder on a sidewall and the filter retainer includes:

a filter cover pivotally mounted adjacent the opening to the filter casing including a catch arranged to engage the resilient latch when the filter cover is in a closed position covering the opening to the filter casing;

a cam having a cam surface to engage the shoulder on the filter cartridge when the cam is in a first position and to disengage from the shoulder when the cam is in a second position; and a pivotally mounted lever arranged to rotate the cam between the first position and the second position.

6. The refrigerator according to claim 5, wherein the filter cover is resiliently biased to an open position and wherein the cam engages the resilient latch to disengage the resilient latch from the catch when the cam is rotated from the first position to the second position by the lever thereby releasing the filter cover to pivot to the open position.

7. The refrigerator according to claim 6, wherein rotation of the cam from the first position to the second position first disengages the resilient latch from the catch and then disengages the cam surface from the shoulder to allow removal of the filter cartridge from the filter casing.

8. The refrigerator according to claim 2, wherein the filter retainer comprises:

a button mounted to the filter casing axially movable along an axis parallel to the filter cartridge between a first position and a second position and resiliently biased to the first position and arranged to hold the filter cartridge connected to the head assembly in the first position and to release the filter cartridge in the second position; and a lever pivotally mounted to overlie the button in a first position and to move the button from the first position to the second position to release the filter cartridge and allow removal of the filter cartridge upon movement to a second position.

9. The refrigerator according to claim 8, wherein the lever includes a first end operated by a user and a second end engaged by the button and the lever is pivotally mounted at a point spaced from the second end of the lever.

10. The refrigerator according to claim 9, wherein pivot is positioned for the lever to be resiliently biased over center about the pivot in the first position and in the second position.

11. The refrigerator according to claim 2, wherein the filter casing includes at least one generally funnel shaped recess in a sidewall beginning adjacent the opening into the dispenser housing, and wherein the filter cartridge includes at least one guide rail along a sidewall positioned to engage the funnel shaped recess when the filter cartridge is inserted into the filter casing, whereby the funnel shaped recess rotates the filter cartridge into the correct position to connect with the head assembly when fully inserted into the filter casing.

12. The refrigerator according to claim 11, wherein the filter cartridge and the filter casing are generally cylindrical in cross section.

13. The refrigerator according to claim 11, wherein the widest portion of the generally funnel shaped recess is adjacent the dispenser housing.

14. The refrigerator according to claim 2, wherein the refrigerated space includes a below freezing freezer compartment, the insulated door closes the freezer compartment, and wherein the door liner includes an access opening adjacent the filter casing; and further including an insulated cover for the access opening, and insulation in the freezer door to cool the filter cartridge to an above freezing temperature.

15. The refrigerator according to claim 14, further including a valve housing adjacent the filter casing and accessible through the access opening and including at least one water valve in the valve housing connected in the water supply and the head assembly.

16. A refrigerator having an insulated cabinet forming a refrigerated space;

an insulated door closing the refrigerated space having an outer panel and a liner;

a water supply to the door;

a water dispenser comprising;

a dispenser housing having side walls, a top and a bottom in the door extending inwardly from the outer panel toward the liner;

a water outlet in the dispenser housing adjacent the top of the dispenser housing;

a filter casing in the door opening into the bottom of the dispenser housing including:

a top wall positioned in the bottom of the dispenser housing;

a head assembly at the bottom of the filter casing connected to the water supply and to the water outlet and including a filter casing drain;

a filter cartridge positioned in the filter casing connected to the head assembly;

a filter retainer mounted adjacent the opening into the filter casing and arranged to hold the filter cartridge connected to the head assembly in a first position and to release the filter cartridge in a second position, wherein moving the filter retainer to the second position allows the filter cartridge to be disconnected from the head assembly and removed from the filter casing; and a drain line leading from the filter casing drain to a pan outside the refrigerated space.

17. The refrigerator according to claim 16, wherein insulated door is hingedly mounted to the insulated cabinet with at least one hollow hinge pin and the drain line passes through the hollow hinge pin to the pan.

18. The refrigerator according to claim 16, wherein the refrigerator includes a machinery compartment having a condensate pan and the drain line extends out of the insulated door and wherein a drain catch extends below the insulated door under the drain line when the insulated door is in a closed position, and the drain catch conducts water from the drain line to the condensate pan.

19. The refrigerator according to claim 16, wherein the refrigerated space includes a below freezing freezer compartment, the insulated door closes the freezer compartment, and wherein the door liner includes an access opening adjacent the filter casing; and further including an insulated closure for the access opening, and insulation in the freezer door to cool the filter cartridge to an above freezing temperature.

20. The refrigerator according to claim 16, wherein the filter casing includes a resilient latch, the filter cartridge includes a shoulder on a sidewall and the filter retainer includes:

a filter cover pivotally mounted to the top wall adjacent the opening to the filter casing and including a catch arranged to engage the resilient latch when the filter cover is in a closed position covering the opening to the filter casing;

a cam having a cam surface to engage the shoulder on the filter cartridge when the cam is in a first position and to disengage from the shoulder when the cam is in a second position; and a pivotally mounted lever arranged to rotate the cam between the first position and the second position.

* * * * *